US009384882B2

(12) United States Patent
Meun et al.

(10) Patent No.: US 9,384,882 B2
(45) Date of Patent: Jul. 5, 2016

(54) NOISE REDUCING SOLENOID APPARATUS FOR SHIFT LEVER

(71) Applicants: SL Corporation, Daegu (KR); GENES Electromechanical Systerm, Gyeongsan, Gyeongsangbuk-Do (KR)

(72) Inventors: Sang Jin Meun, Daegu (KR); Ki Chul Choi, Gyeongsan (KR)

(73) Assignees: SL Corporation, Daegu (KR); GENES Electromechanical System, Gyeongsan (KR)

( * ) Notice: Subject to any disclaimer, the term of this patent is extended or adjusted under 35 U.S.C. 154(b) by 28 days.

(21) Appl. No.: 14/295,088

(22) Filed: Jun. 3, 2014

(65) Prior Publication Data

US 2014/0375401 A1 Dec. 25, 2014

(30) Foreign Application Priority Data

Jun. 24, 2013 (KR) ..... 10-2013-0072494

(51) Int. Cl.
*H01F 7/08* (2006.01)

(52) U.S. Cl.
CPC ..... *H01F 7/088* (2013.01)

(58) Field of Classification Search
CPC ..... H01F 7/088; H01F 7/1607; H01F 7/081; H01F 2007/086; H01H 51/065; H01H 50/36
USPC ..... 335/220–229, 255, 257
See application file for complete search history.

(56) References Cited

U.S. PATENT DOCUMENTS 4,887,702 A * 12/1989 Ratke ..... B60R 25/02144 192/220.4
5,275,065 A * 1/1994 Ruiter ..... F16H 59/10 192/220.2
7,982,565 B2 * 7/2011 Bradfield ..... F02N 15/067 335/126
8,193,882 B2 * 6/2012 Murata ..... F02N 11/087 335/126
8,400,242 B2 * 3/2013 Zelmer ..... F16H 63/3475 335/220
2004/0100345 A1 * 5/2004 Kobayashi ..... F16H 61/32 335/220
2005/0093662 A1 * 5/2005 Hoffman ..... F02N 15/067 335/220
2007/0194867 A1 * 8/2007 Kurasawa ..... H01H 50/305 335/126

FOREIGN PATENT DOCUMENTS

KR 10-1142968 B1 4/2012
KR 10-1144654 B1 5/2012
KR 10-1193468 B1 10/2012
KR 10-2012-0121473 A 11/2012
KR 10-2013-0064318 6/2013
KR 20-2014-0001771 U 3/2014

* cited by examiner

*Primary Examiner* — Bernard Rojas
(74) *Attorney, Agent, or Firm* — Mintz Levin Cohn Ferris Glovsky and Popeo, P.C.; Kongsik Kim; Carolina Säve

(57) ABSTRACT

A solenoid apparatus for a shift lever is provided that includes a bobbin having an aperture therein and a coil wound therearound. A core is mounted on the exterior of the bobbin, surrounds an end portion of the aperture, and is magnetized by a current applied to the coil. A plunger moves along the inside of the aperture and is magnetized by the current. A shaft is inserted into, and penetrates through, the plunger and a buffer member is disposed at an end of the shaft exposed from the plunger. An elastic member is disposed between the buffer member and an end of the aperture. The plunger moves toward the core due to combined forces obtained by combining forces applied in a direction of the movement of the plunger by a magnetic field generated by the current and attractive forces generated vertically between the plunger and the core.

10 Claims, 7 Drawing Sheets

NOISE REDUCING SOLENOID APPARATUS FOR SHIFT LEVER

CROSS-REFERENCE TO RELATED APPLICATIONS

This application claims priority to Korean Patent Application No. 10-2013-0072494 filed on Jun. 24, 2013, the disclosure of which is incorporated herein by reference in its entirety.

TECHNICAL FIELD

The invention relates to a solenoid apparatus for a shift lever, and more particularly, to a solenoid apparatus for a shift lever that reduces noise generated during the operation of the solenoid apparatus for restraining or releasing the movement of the shift lever.

RELATED ART

Automotive transmissions change gear ratios to constantly maintain the rotation of an engine according to the speed of a vehicle. A driver may operate a shift lever of an automotive transmission to change the gear ratio, Automotive transmissions may he classified into two types of transmissions: a manual transmission and an automatic transmission, In the manual transmission, a driver is able to manually change gears in the transmission. Conversely, in the automatic transmission, the gears are automatically changed according to the speed of a vehicle in response to a drive (D) mode being selected by a driver.

There is another type of automotive transmission, i.e., a manumatic transmission that performs both a manual shift operation and an automatic shift operation. The manumatic transmission may perform the manual shift operation in response to a driver increasing or decreasing the gear ratio, and simultaneously, perform the automatic shift operation in parallel, or may include an automotive transmission together with a manual transmission.

The automotive transmission includes a shift lock function called a transmission lock function. The shift lock function was developed to prevent accidents associated with sudden unintended acceleration. The shift lock function includes a primary shift lock function configured to prevent a gear position of a shift lever from moving from the parking position "P" or the neutral position "N" to another gear position unless a brake pedal is depressed (e.g., engaged), and a secondary shift lock function configured to prevent the gear position of the shift lever from moving to the reverse position "R" when the vehicle is moving in a forward direction at a predetermined speed or greater. In addition, to prevent a driver malfunction, a full shift lock function may be provided for all gear positions.

The shift lock function is performed by a solenoid apparatus configured to restrain, or release the movement of the shift lever by being connected to a shift lever. The solenoid apparatus may be applied to the operation of a valve or a lever due to its electromagnet functions and may thus be employed in various devices such as a valve device, a mechanic device and a shift lock device for an automotive shift lever.

The solenoid apparatus may include a plunge, provided in a bobbin having a coil wound therearound and is movable within the bobbin, and a core, disposed at the end of the bobbin and is magnetized by a current applied to the coil. In response to the magnetization of the core, an attractive force may be generated between the plunger and the core, and as a result the plunger may begin to move. However, in a typical solenoid apparatus, the core is disposed on a path of the movement of the plunger, and may thus generate noise by colliding with the plunger during the movement of the plunger. In addition, due to the generation of a magnetic field by a current applied to the coil and the generation of an attractive force between the plunger and the core, the plunger may not be able to decelerate, and may thus collide with the core, thereby causing more impact and noise. Therefore, a method is needed to minimize the generation of noise during the movement of a plunger within a solenoid apparatus.

SUMMARY

Exemplary embodiments of the invention provide a solenoid apparatus for a shift lever, in which a core that is magnetized by a current applied to a coil wound around a bobbin may be mounted to surround a plunger to prevent noise from being generated in response to the plunger and the core colliding during the movement of the plunger. In addition, the present invention provides a solenoid apparatus for a shift lever, in which noise may be reduced by providing a buffer member configured to absorb the impact from the movement of a plunger within a bobbin. Further, the present invention provides a solenoid apparatus for a shift lever, in which a coil and a core may be disposed side-by-side along a direction of the movement of a plunger to allow the plunger to gradually decelerate as the plunger approaches a core, without the aid of additional elements.

However, exemplary embodiments of the invention are not restricted to those set forth herein. The above and other exemplary embodiments of the invention will become more apparent to one of ordinary skill in the art to which the invention pertains by referencing the detailed description of the invention given below.

According to an exemplary embodiment of the invention, a solenoid apparatus for a shift lever, may include: a bobbin having an aperture formed therein and a coil wound therearound; a core configured to be mounted on the exterior of one end of the bobbin, to surround an end portion of the aperture, and be magnetized by a current applied to the coil; a plunger configured to move along the inside of the aperture and be magnetized by the current; a shaft configured to be inserted into, and penetrate through, the plunger; a buffer member configured to be disposed at an end of the shaft exposed from the plunger; and an elastic member configured to be disposed between the buffer member and an end of the aperture, wherein the plunger moves toward the core due to combined forces obtained by combining forces applied in a direction of the movement of the plunger by a magnetic field generated by the current and attractive forces generated vertically between the plunger and the core.

According to the exemplary embodiments, since the core, magnetized by a magnetic field generated in response to the application of a current to the coil, may be mounted to surround the aperture within the bobbin passed through by the plunger, noise may be prevented from being generated when the plunger and the core collide. In addition, since the core may be mounted to surround the end portion of the aperture, the attractive force between the plunger and the core may increase as the plunger approaches the full-stroke position. Accordingly, the plunger may be able to effectively decelerate without the aid of additional elements. Moreover, since the buffer member configured to absorb the impact on the plunger, may be disposed at the initial position or the full-stroke position, respectively, the generation of noise during the movement of the plunger may be reduced.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
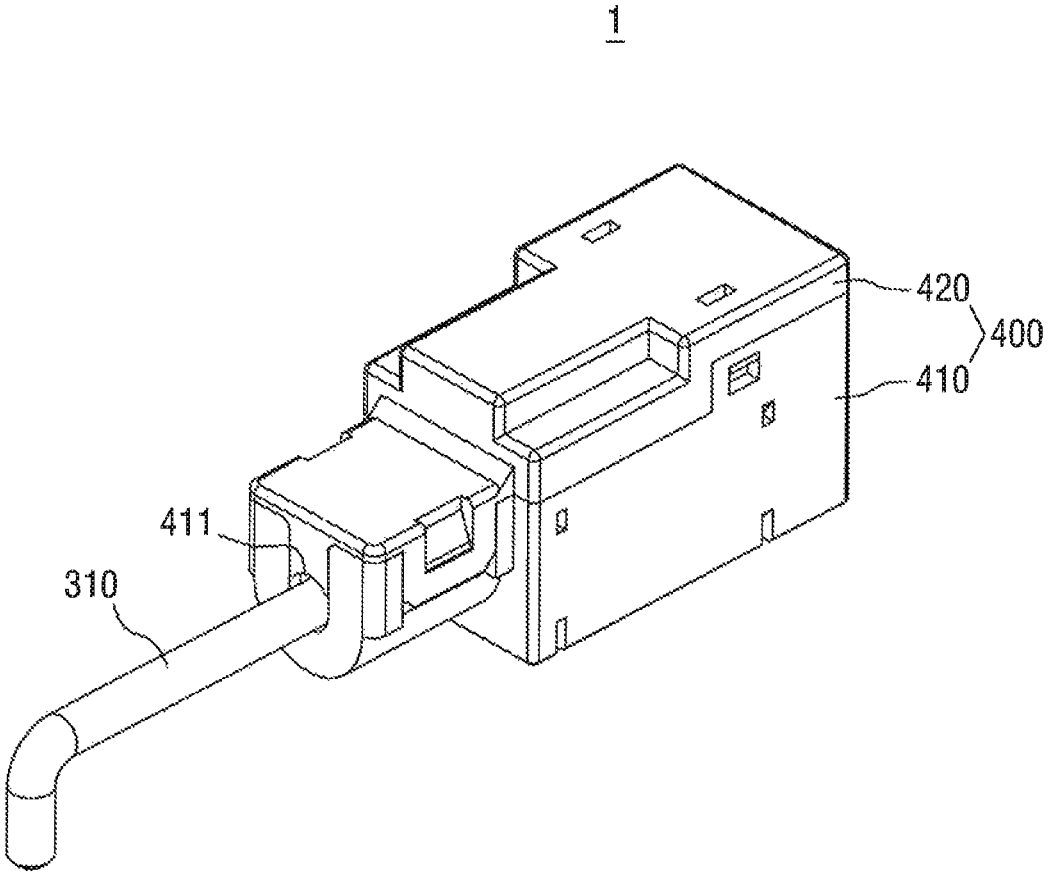
FIG. 1 is an exemplary view illustrating a solenoid apparatus for a shift lever, according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Advantages and features of the invention and methods of accomplishing the same may be understood more readily by reference to the following detailed description of exemplary embodiments and the accompanying drawings. The invention may, however, be embodied in many different provides and should not be construed as being limited to the exemplary embodiments set forth herein. Rather, these exemplary embodiments are provided so that this disclosure will be thorough and complete and will fully convey the concept of the invention to those skilled in the art, and the invention will only be defined by the appended claims. Like reference numerals refer to like elements throughout the specification.

The exemplary embodiments and features of the invention and methods for achieving the exemplary embodiments and features will be apparent by referring to the exemplary embodiments to be described in detail with reference to the accompanying drawings. However, the invention is not limited to the exemplary embodiments disclosed hereinafter, but can be implemented in diverse provides. The matters defined in the description, such as the detailed construction and elements, are nothing but specific details provided to assist those of ordinary skill in the art in a comprehensive understanding of the invention, and the invention is only defined within the scope of the appended claims.

Exemplary embodiments will hereinafter be described with reference to the accompanying drawings.

Figure 2:
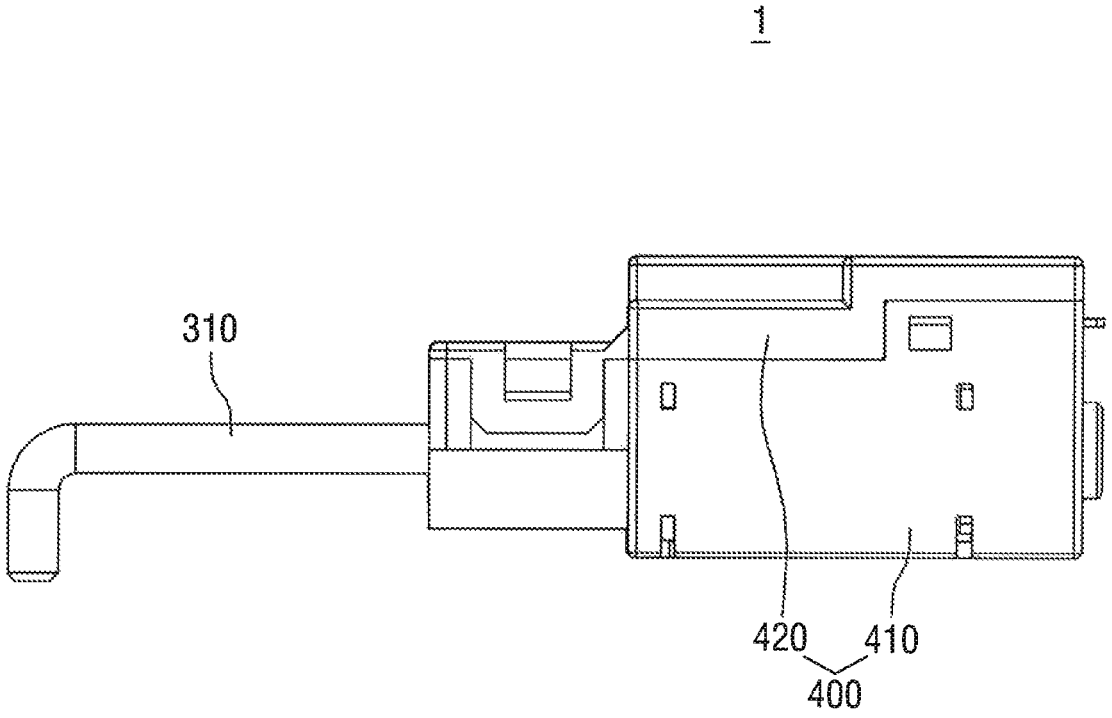
FIG. 2 is an exemplary side view illustrating the solenoid apparatus of FIG. 1 according to an exemplary embodiment of the present invention.
Figure 3:
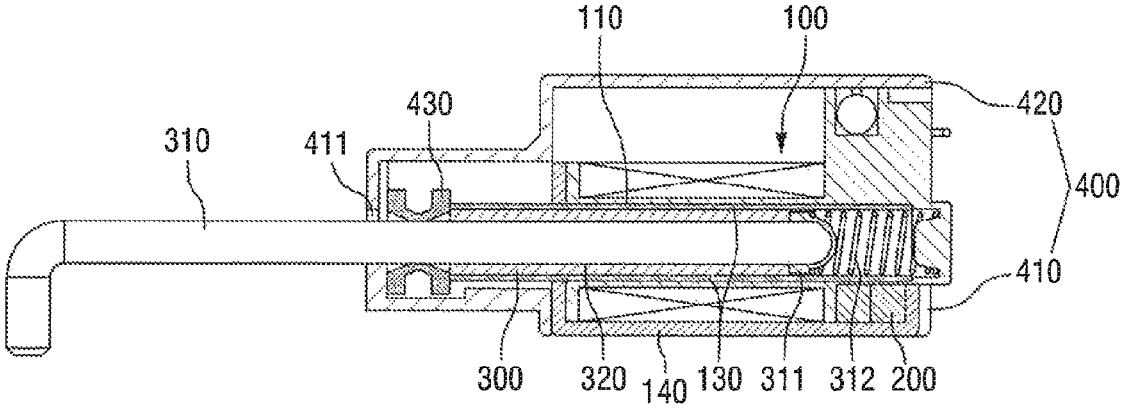
FIG. 3 is an exemplary cross-sectional view illustrating the solenoid apparatus of FIG. 1 according to an exemplary embodiment of the present invention.

FIG. 1 is an exemplary view illustrating a solenoid apparatus for a shift lever, according to an exemplary embodiment of the invention, FIG. 2 is an exemplary side view illustrating the solenoid apparatus of FIG. 1, and FIG. 3 is an exemplary cross-sectional view illustrating the solenoid apparatus of FIG. 1. Referring to FIGS. 1 to 3, a solenoid apparatus 1 for a shift lever may include a bobbin 100, a core 200, a plunger 300 and a housing 400.

An aperture 110 may be formed in the bobbin 100 along a longitudinal direction of the bobbin 100. A coil 120 to which a current may be applied may be wound around the bobbin 100. In response to a current being applied to the coil 120, a magnetic field may be generated. In an exemplary embodiment, the aperture 110 may be cylindrical, but the invention is not limited thereto. The inner shape of the aperture 110 may be the same shape as the outer shape of the plunger 300, which may be configured to move along the inside of the aperture 110 while contacting the inner side surface of the aperture 110.

Figure 4:
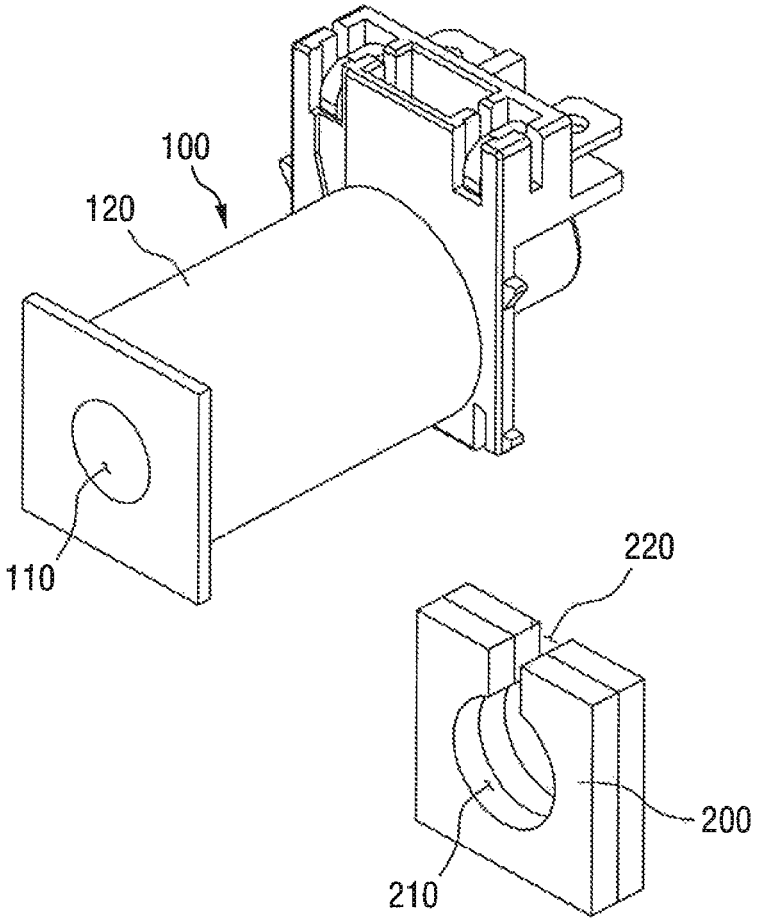
FIG. 4 is an exemplary view illustrating a core to be mounted within a bobbin, according to an exemplary embodiment of the present invention.

The bobbin 100 may include a sleeve 130 disposed on the inside of the aperture 110 to maintain the inner diameter of the aperture 110 and surround the outer circumference of the plunger 300 inserted into the aperture 110. The sleeve 130 may be formed of a material with a substantially smooth surface, such as brass, for the plunger 300 to smoothly move therethrough. In response to a current being applied to the coil 120, a magnetic field may be generated, and the core 200 may be magnetized by the magnetic field. In an exemplary embodiment, a cavity 210 may be formed in the core 200, and the core 200 may be mounted at the end of the bobbin 100 to surround an end portion of the aperture 110, as illustrated in FIG. 4.

For the ease of assembly and disassembly, a slit 220 may be formed on one side of the outer circumference of the core 200 for the core 200 to be elastically deformable. The slit 220 may be connected to the cavity 210. Accordingly, the core 200 may be elastically deformable in a direction in which the slit 220 widens or narrows, and thus, the assembly and disassembly of the core 200 may be facilitated. The core 200 may be formed of a ferromagnetic material such as pure iron, nickel, or an alloy thereof. In response to a substantial magnetic field being generated extraneous to the core 200, the core 200 may be magnetized in the direction of the magnetic field. Once magnetized, the core 200, similar to a magnet, may be configured to generate attractive force and may thus attract other ferromagnetic bodies even after the magnetic field no longer exists.

The plunger 300 may be formed to conform to the inner shape of the aperture 110, and may thus be able to move along the inside of the aperture 110. The plunger 300 may be formed of a ferromagnetic material to serve as a moving iron core in response to a current being applied to the coil 120. In an exemplary embodiment, the plunger 300 may be configured to move along the inside of the aperture 110. More specifically, in response to the sleeve 130 being disposed on the inside of the aperture 110, the plunger 300 may be configured to move along the inside of the sleeve 130. An insertion aperture 320 may be formed in the plunger 300, and a shaft 310 may be inserted into the insertion aperture 320. The shaft 310 may be inserted into the plunger 310 on one side (e.g., a first side) of the insertion aperture 320, and may be configured to penetrate through the plunger 310 on the other side (e.g., a second side) of the insertion aperture 320. The plunger 300 and the shaft 310 may be formed in one body with each other through press fitting.

In an exemplary embodiment, the insertion aperture 320 may be formed in the plunger 300, the shaft 310 may be inserted into the insertion aperture 320, and press fitting may be performed. In this exemplary embodiment, the weight of the plunger 300 may be reduced and the operation of the plunger 300 may be facilitated. A first buffer member 311 may be disposed at the end of the shaft 310 exposed from the plunger 300. An elastic member 312 may be disposed between the first buffer member 311 and the end of the aperture 110. In response to a current being applied to the coil 120, the core 200 and the plunger 300 may be magnetized, and the plunger 300 may be configured to move to a full-stroke position and collide with the end of the aperture 110. The first buffer member 311 may reduce the impact or noise from the collision of the plunger 300 with the end of the aperture 110.

The elastic member 312 may contract or expand based on (e.g., corresponding to) the movement of the plunger 300. More specifically, the elastic member 312 may contract in response to the plunger 300 being at the full-stroke position upon the application of a current to the coil 120. In response to no current being applied to the coil 120, the elastic member 312 may expand due to the elastic force to return the plunger 300 to an original position or an initial position of the plunger 300.

Figure 5:
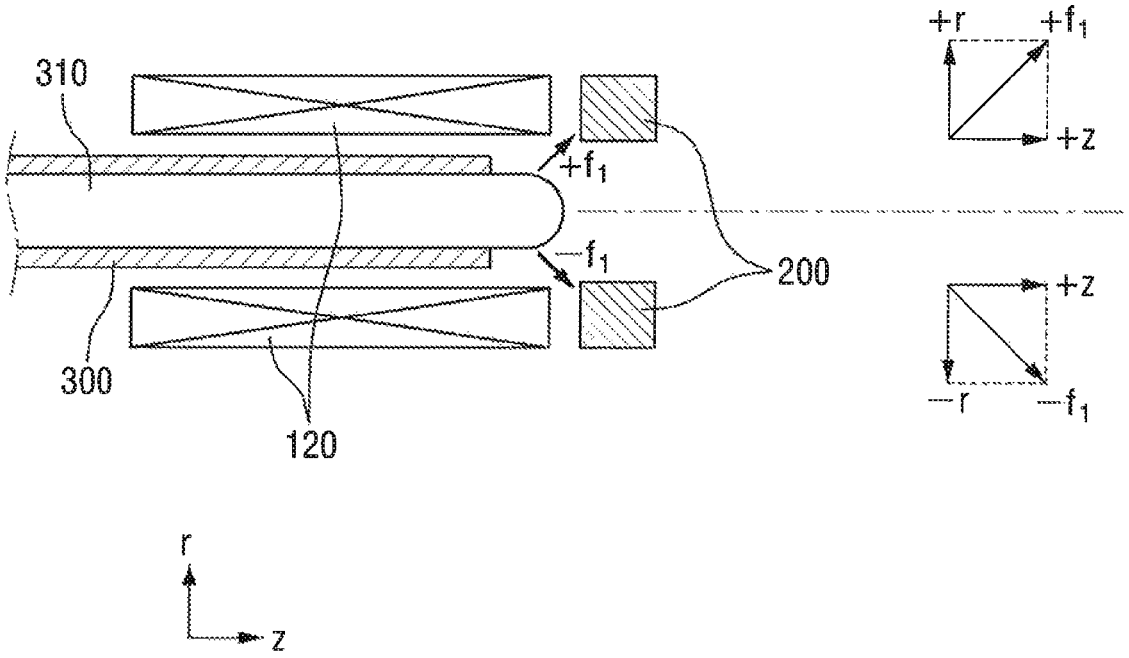
FIG. 5 is an exemplary view illustrating the force applied to a plunger at its initial position in response to the application of a current to the plunger, according to an exemplary embodiment of the present invention.
Figure 6:
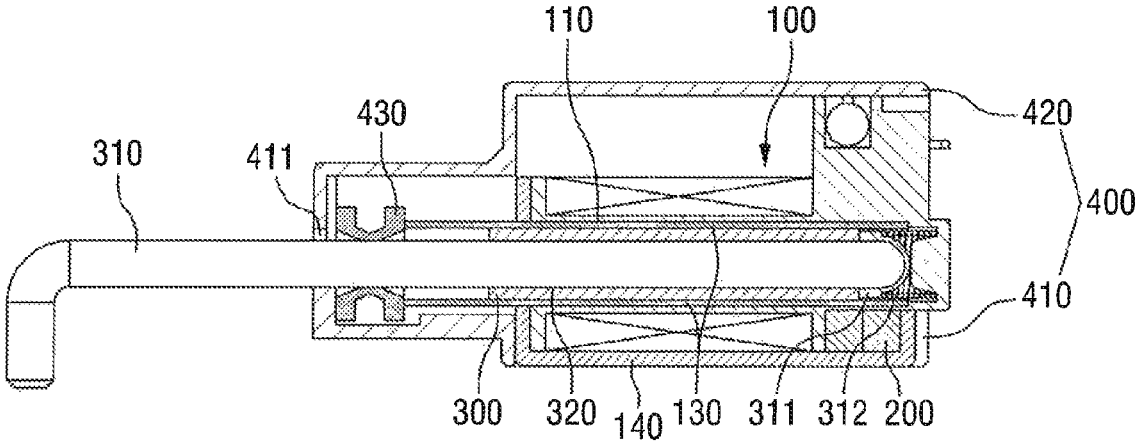
FIG. 6 is an exemplary cross-sectional view illustrating a plunger at its full-stroke position, according to an exemplary embodiment of the present invention.
Figure 7:
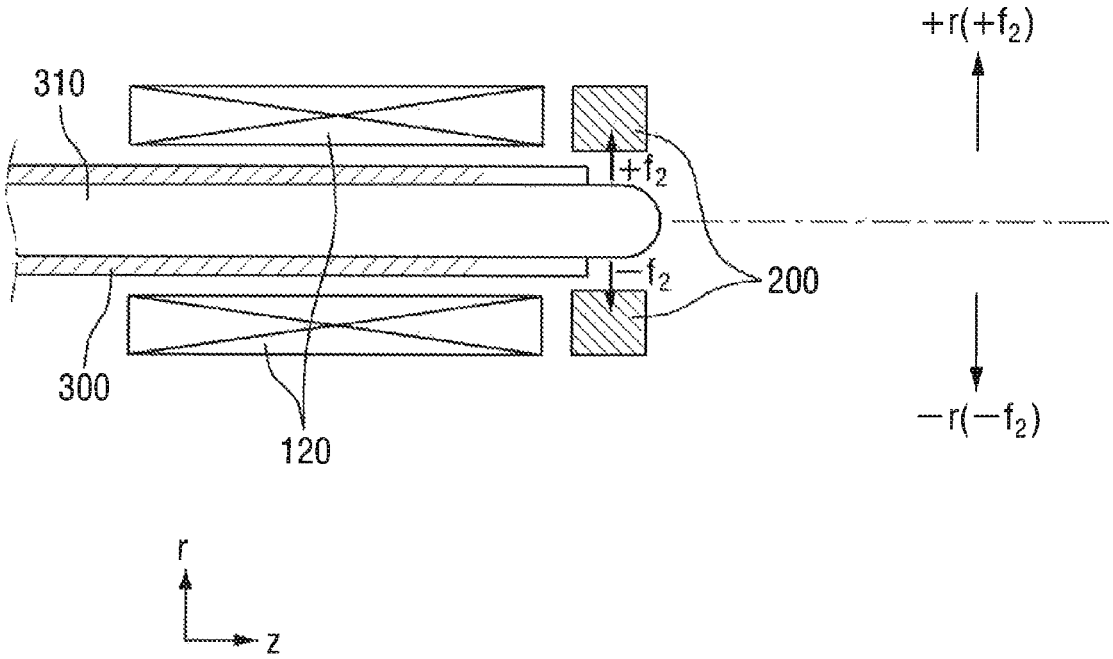
FIG. 7 is an exemplary view illustrating the force applied to a plunger at its full-stroke position in response to the application of a current to the plunger, according to an exemplary embodiment of the present invention.

In an exemplary embodiment, the coil 120 and the core 200 may be disposed side-by-side (e.g., adjacent to each other) along a direction of the movement of the plunger 300. in this exemplary embodiment, the adjustment of the moving speed of the plunger 300 may be facilitated. In other words, in response to a current being applied to the coil 120 when the plunger 300 is at the initial position, as illustrated in FIG. 3, a magnetic field may be generated, and the core 200 and the plunger 300 may be magnetized by the magnetic field to generate attractive forces +r and −r, as illustrated in FIG. 5. Due to combined forces +f1 and −f1, obtained by combining force (+z) of the magnetic field and the attractive forces +r and −r, the plunger 300 may be configured to begin to move. As the plunger 300 approaches the full-stroke position, as illustrated in FIG. 6, the attractive forces +r and −r, generated between the core 200 and the plunger 300, may become stronger (e.g., the attractive forces +r and −r may increase), and the force +z of the magnetic field may become weaker (e.g., the force_z of the magnetic field may decrease), as illustrated in FIG. 7, and as a result, the plunger 300 may be able to gradually decelerate.

In other words, at an early stage of the application of a current to the coil 120, the plunger 300 may be configured to begin to move from the initial position due to the combined forces +f1 and −f1, which are substantially strong. However, as the plunger 300 approaches the full-stroke position, the attractive forces +r and −r, applied vertically by the core 200, may substantially increase, and thus, the plunger 300 may gradually decelerate due to forces −f2 and −f2 applied vertically thereto.

When the core 200 is disposed on a path of the movement of the plunger 300, the plunger 300 may not be able to gradually decelerate as it approaches the full-stroke position since the attractive force is applied in the direction of the movement of the plunger 300, and may thus cause noise by colliding with the core 200. However, in an exemplary embodiment, since the core 200 surrounds the plunger 300, the plunger 300 may be able to decelerate as it approaches the full-stroke position due to substantially strong force applied thereto between the plunger 300 and the core 200, and thus, noise that may be caused by the collision of the plunger 300 with the core 200 may be prevented.

In an exemplary embodiment, since no lubricant such as grease is required for adjusting the moving speed of the plunger 300, the maintenance and repair of the solenoid apparatus 1 may be facilitated. The symbols "+" and "−", as used in FIGS. 5 and 7, indicate the directions of force. For example, force +r and force −r may be identical in magnitude, but differ from each other in the direction in which they are generated. In FIGS. 5 and 7, the plunger 300 and the core 200 are illustrated as being magnetized as a north (N) pole and a south (S) pole, respectively. However, the polarity of the plunger 300 and the core 200 may vary depending on the direction in which to apply a current to the coil 120.

In the exemplary embodiment illustrated in FIG. 7, since the force of a magnetic field generated by a current applied to the coil 120 is relatively weak, the forces +f2 and −f2, applied to the plunger 300, may have the about same magnitude as the attractive forces +r and −r, applied vertically by the core 200, but the invention is not limited thereto. In other words, in the exemplary embodiment illustrated in FIG. 7, like in the exemplary embodiment illustrated in FIG. 5, combined forces, obtained by combining the force of a magnetic field generated in response to a current being applied to the coil 120 and attractive forces generated in response to the core 200 and the plunger being magnetized by the magnetic field, may be applied to the plunger 300.

Furthermore, the housing 400 may form an inner space partitioned from the exterior of the solenoid apparatus 1. In an exemplary embodiment, the housing 400 may include a first housing 410, having an opening at a top and a bracket 140 coupled thereto, and a second housing 420 configured to serve as a cover for covering the opening at the top of the first housing 410, but the invention is not limited thereto. In other words, the housing 400 may be formed in one body, or may include a plurality of elements assembled thereinto. In addition, the bobbin 100 may be accommodated within the bracket 140.

An exposure aperture 411 may be formed on the first housing 410 to expose the shaft 310 therethrough. The shaft 310, which may be exposed through the exposure aperture 411, may be directly or indirectly connected to a shift lever (not illustrated), and may thus may be configured to restrain or release the movement of the shift lever. A second buffer member 430 may be disposed on the inside of the first housing 410 near (e.g., adjacent to) the exposure aperture 411. In response to no current being applied to the coil 120, the plunger 300 may return from the full-stroke position to the original position due to the elastic force of the elastic member 312. In particular, the second buffer member 430 may be configured to absorb the impact from the movement of the plunger 300 and may thus prevent the generation of noise.

While the invention has been particularly shown and described with reference to exemplary embodiments thereof, it will be understood by those of ordinary skill in the art that various changes in provide and detail may be made therein without departing from the spirit and scope of the invention as defined by the following claims. The exemplary embodiments should be considered in a descriptive sense only and not for purposes of limitation.

What is claimed is:

1. A solenoid apparatus for a shift lever, comprising:

a bobbin having an aperture formed therein and a coil wound therearound;

a core configured to be mounted on the exterior of one end of the bobbin, to surround an end portion of the aperture, and be magnetized by a current applied to the coil;

a plunger configured to move along the inside of the aperture and be magnetized by the current applied to the coil; and a shaft configured to be inserted into the plunger, wherein when the plunger approaches a full stroke position, a portion of the plunger is surrounded by a through-hole of the core and moves toward the core due to combined forces obtained by combining forces applied in a direction of the movement of the plunger by a magnetic field generated by the current and attractive forces generated vertically between the plunger and the core.

2. The solenoid apparatus of claim 1, wherein the shaft is configured to penetrate through the plunger and the solenoid apparatus further comprises:

a buffer member disposed at an end of the shaft exposed from the plunger; and an elastic member disposed between the buffer member and an end of the plunger.

3. The solenoid apparatus of claim 1, wherein the through-hole formed in the core surrounds the end portion of the aperture.

4. The solenoid apparatus of claim 1, wherein the core includes a slit that enables the core to be elastically deformable.

5. The solenoid apparatus of claim 1, wherein the core is disposed adjacent to the coil in the direction of the movement of the plunger.

6. The solenoid apparatus of claim 1, wherein the plunger is further configured to gradually decelerate as the plunger approaches a full-stroke position, due to the attractive forces.

7. The solenoid apparatus of claim 6, wherein at the full-stroke position, the attractive forces are stronger than the forces applied in the direction of the movement of the plunger.

8. The solenoid apparatus of claim 2, wherein the shaft is further configured to be exposed through an exposure aperture formed on a housing and the solenoid apparatus further includes another buffer member disposed within the housing adjacent to the exposure aperture.

9. The solenoid apparatus of claim 8, wherein the other buffer member adjacent to the exposure hole is further configured to absorb impact from the plunger returning to an original position due to elastic force of the elastic member in response to the current being no longer applied.

10. The solenoid apparatus of claim 1, wherein the plunger and the shaft are integrally formed through press fitting.

* * * * *